United States Patent [19]

Sanford

[11] Patent Number: 4,927,354

[45] Date of Patent: May 22, 1990

[54] RETRACTABLE CIGARETTE LIGHTER HOLDER

[76] Inventor: Kirk Sanford, 18441 Vine St., Hesperia, Calif. 92345

[21] Appl. No.: 215,777

[22] Filed: Jul. 5, 1988

[51] Int. Cl.[5] ..... F23Q 2/32

[52] U.S. Cl. ..... 431/253; 431/343; 206/87

[58] Field of Search ..... 431/253, 343; 206/86, 206/85, 94, 87, 88; 312/86; 119/96

[56] References Cited

U.S. PATENT DOCUMENTS

| | | | |
|---|---|---|---|
| 2,042,808 | 6/1936 | Seebeck . | |
| 2,314,504 | 3/1943 | Lifchultz | 119/96 X |
| 2,737,036 | 3/1956 | Simpson . | |
| 2,789,424 | 4/1957 | Lorio . | |
| 4,000,812 | 1/1977 | Pisarski et al. | 206/87 |
| 4,082,496 | 4/1978 | Johnson | 431/343 |
| 4,363,432 | 12/1982 | Warthen | 202/87 X |
| 4,486,169 | 12/1984 | Lewis | 431/253 |

*Primary Examiner*—Randall L. Green

*Attorney, Agent, or Firm*—Edward E. Roberts

[57] ABSTRACT

A device comprising in combination a cigarette lighter and a housing with a retractable reel mechanism contained therein, the housing being formed of two generally cup-shaped halves secured together and housing a coil spring and retractable take-up spool therein for connection to one end of a cord or the like, the other end being coupled to a fastener configured and adapted for captively and releasably retaining the cigarette lighter. Cord retraining means is included for retaining the amount of extension of the cord at a selected point, the release of which allows the reel mechanism to retract the lighter. A clip member or the like is attached to a side surface of the housing for enabling attachment of the device to an article of wearing apparel, such as a belt or waistband of trousers. In one embodiment, the circumference of the housing is cut away or contoured to form a lighter receiving cavity or compartment configured and adapted for releasably retaining the cigarette lighter.

13 Claims, 1 Drawing Sheet

RETRACTABLE CIGARETTE LIGHTER HOLDER

BACKGROUND OF THE INVENTION

The background of the invention will be discussed in two parts.

1. Field of the Invention

This invention relates to cigarette lighters, and more particularly, to a retractable cigarette lighter holder.

2. Description of the Prior Art

Cigarette lighters are utilized for a variety of purposes, both by smokers and non-smokers. Many cigarette lighters in use today are disposable, that is, with a fuel reservoir, and ignition mechanism not intended for replacement or refill. Cigarette lighters are normally of relatively small dimensions, and may readily be carried in the pocket of pants or a shirt, or in a purse. In most instances, lighters are not the most easily procured items from pocket or purses, and have a propensity for being misplaced or lost.

Various devices have been employed for attachment to lighters, such as chains of the type used for watch fobs. Other devices include cord. Such devices are shown and described in U.S. Pat. No. 4,082,496, entitled "Chain Secured Cigarette Lighter", issued on Apr. 4, 1978 to Johnson; and U.S. Pat. No. 2,737,036, entitled "Combined Suspension Means and Wind Guard for Cigarette Lighter", issued on Mar. 6, 1956 to Simpson. An ordinary "Safety Chain" is shown in U.S. Pat. No. 2,042,808. issued June 2, 1936 to Seebeck.

U.S. Pat. No. 2,789,424, entitled "Cigarette Lighter", issued to Lorio on Apr. 23, 1957, such patent disclosing a cigarette lighter including an expansion band for wearing on the wrist.

Another device is shown and described in U.S. Pat. No. 4,486,169, entitled "Cigarette Lighter Securing Accessory", such patent issuing to Lewis on Dec. 4, 1984, the patent disclosing a box like housing with a false bottom containing a retractable cord for attachment to a cigarette lighter which can be contained within the housing. Other embodiments are shown, and some of the embodiments include clips for attachment to wearing apparel such as a belt.

Retractable reel mechanisms have been used for retaining a variety of devices, such as keys, rosary beads, or clotheslines, and such devices are shown in U.S. Pat. Nos. 2,732,148; 2,781,591; 3,021,901; 3,968,670; and 4,502,226.

Of the above patents, that most relevant to the instant invention is U.S. Pat. No. 4,486,169 to Lewis.

In accordance with an aspect of the invention, it is accordingly an object of the invention to provide a new and improved retractable reel cigarette holding and retaining device.

SUMMARY OF THE INVENTION

The foregoing and other objects of the invention are accomplished by providing a retractable reel mechanism contained within a housing formed of two generally cup-shaped halves secured together and housing a coil spring and retractable take-up spool therein for connection to one end of a cord or the like, the other end being coupled to a fastener configured and adapted for captively and releasably retaining a cigarette lighter. In one embodiment a portion of the circumference of the housing is cut away or contoured to form a lighter receiving cavity or compartment configured and adapted for releasably retaining the cigarette lighter.

Cord retaining means is included for retaining the amount of extension of the cord at a selected point, the release of which allows the reel mechanism to retract the lighter. A clip member or the like is attached to a side surface of the housing for enabling attachment of the device to an article of wearing apparel, such as a belt or waistband of trousers.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Figure 2:
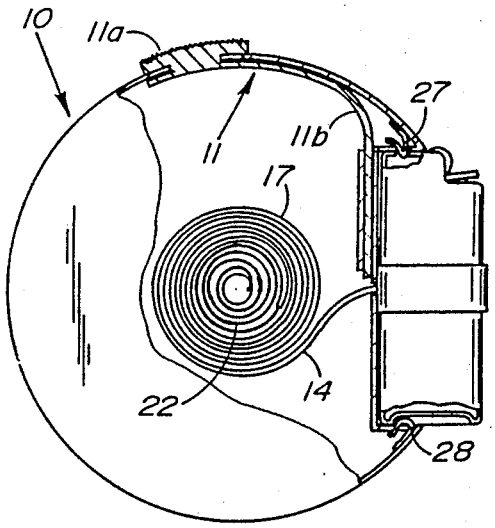
FIG. 2 is a side elevational view, partially broken away, of the holder of FIG. 1, with the lighter nestably received therein.
Figure 1:
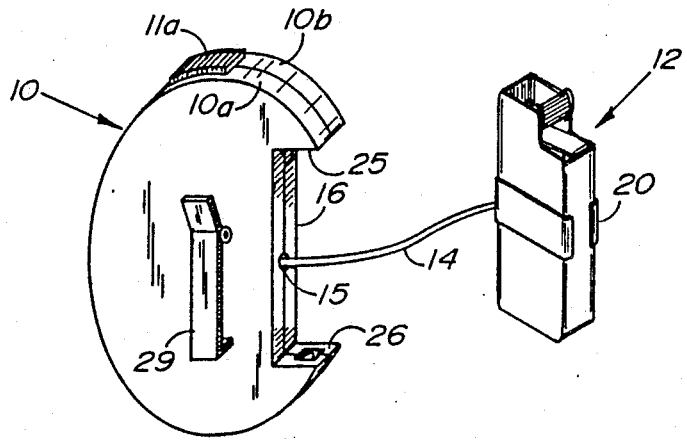
FIG. 1 is a perspective view of the retractable cigarette lighter holder, including the lighter compartment, according to one embodiment of the invention with a lighter attached thereto.

Referring now to the drawings, and particularly to FIGS. 1 and 2, there is shown one embodiment of a cigarette lighter extention and rewinding housing, generally designated 10, for releasably and retractably holding a cigarette lighter 12. A cord 14 extends from an opening 15 in a back wall 16 of a compartment 17 of the housing 10. A suitable fastening means, such as a spring clip 20 is attached to the end of the cord for gripping a portion of the body of the lighter 12.

A retractable reel mechanism is contained within the housing 10, which may be formed of any suitable material such as plastic or metal, and formed of two generally cup-shaped halves **10*a* and 10*b*, which are secured together for defining a hollow interior, which contains coil spring 22 and a retractable take-up spool therein for connection to the captive end of cord 14**.

In certain embodiments the reel and spool mechanism may be of any convenient form, such as that normally employed in retractable tape measuring devices, however, embodiments are also described herein wherein specific reel and spool mechanisms are taught.

In any event, such retractable mechanisms permit extension of the cord 14 against the force of the coil spring 22, and retraction of the cord 14 under force of the spring 22.

Associated with the reel mechanism is means for restraining the cord at selected intervals, or lengths, of the cord. One such means for restraining the cord at selected intervals, or lengths, is illustrated in FIGS. 1 and 2 by cord restraining means 11, which includes knurled button **11*a* and cord contacting extention 11*b*, whereby it is provided that upon extention of the lighter to a desired distance, the button 11*a* is pushed in a first direction to effect frictional contact between extention 11*b* and cord 14** whereby the cord is restrained at the desired length of the cord. Upon movement of button 11*a* in the opposite direction the frictional pressure is removed from the cord allowing the force of the spring to retract the lighter.

Figure 4:
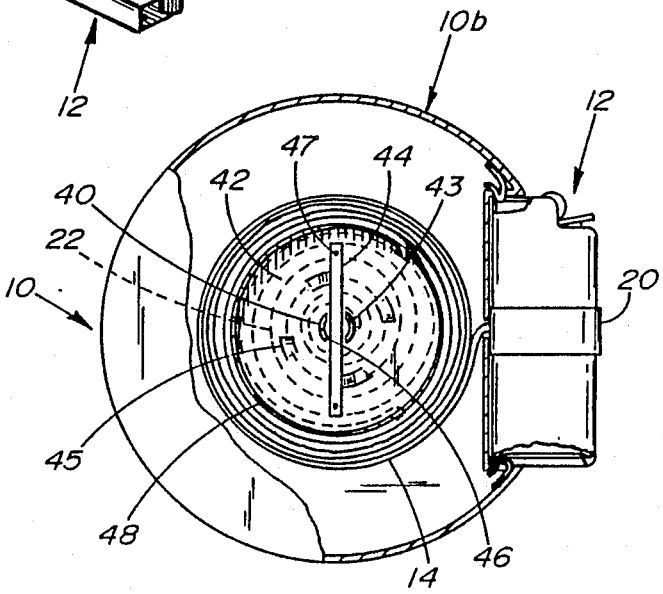
FIG. 4 is a side elevational view, partially broken away, of the holder of FIG. 1, illustrating another embodiment of the invention.

In the embodiment shown in FIGS. 1, 2 and 4, the circumference of the housing 10 is cut away or contoured to form a lighter receiving cavity or compartment 17, which is configured and adapted for releasably retaining the cigarette lighter 12. Compartment 17 includes a back wall 16 and upper and lower generally edges 25 and 26, which are generally parallel to one another and generally perpendicular to the back wall 16. The size and dimension of compartment 17 is such that the body of lighter 12 is substantially received within the compartment to provide a compact assembly within the overall dimensions of the housing 10. The length of the back wall 16 closely approximates that of the length of the lighter 12, while the depth of the edges 25 and 26 is slightly smaller than the width of the lighter 12, with the thickness of the housing closely approximating that of the thickness of the lighter 12.

For the purpose of retaining the lighter 12 within the compartment 17, as illustrated in FIG. 2, the edges 25 and 26 are provide with openings through which extend V-shaped portions of spring members 27 and 28, respectively. Each of the spring members 27 and 28 is formed as a generally V-shaped member with an end thereof suitably secured to the housing on the interior thereof. The V-shaped parts of the spring members 27, 28 are in facing relation to one another and positioned for engaging an existing part of the lighter. For example, the bottom of the lighter includes a recess therein, and the lower spring 28 frictionally engages the surface within this recess. At the top of lighter 12, there is a flame opening, and the V-shaped section of upper spring 27 is configured, dimensioned and positioned for engagement within this opening. It is to be understood that any convenient means may be employed to retain the lighter within the compartment 17, and the means shown is but one preferred arrangement.

For enabling carrying of the housing 10, a clip member 29 is attached to a side surface of the housing 10 for enabling attachment of the holder 10 to an article of wearing apparel, such as a belt or waistband of trousers.

Figure 3:
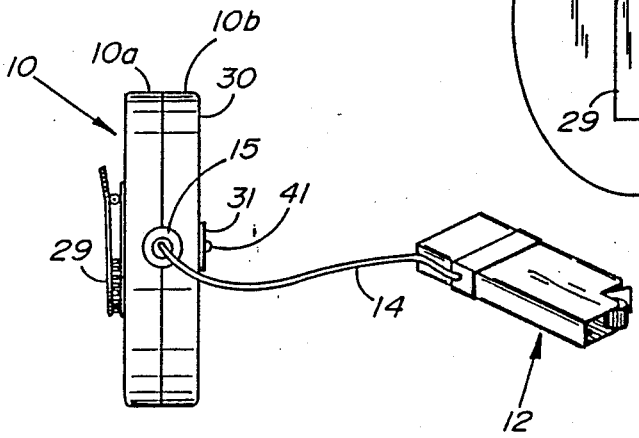
FIG. 3 is a perspective view of the retractable cigarette lighter holder, without the higher compartment, according to another embodiment of the invention with a lighter attached thereto.

Referring now to FIG. 3, there is shown another embodiment of the invention which is essentially the same as the previous embodiment except that the compartment 17 is not included in the housing 30, the lighter 12 thus allowed to be selectively extended from the housing and stored or carried separate from housing 10, such as with a watch fob. In this embodiment, although not shown on the drawing, the cord restraining means 11 of FIGS. 1 and 2 can be located closer to opening 15. In either embodiment, cord 14 can be elastic or inelastic depending upon the desired usage. Further, if desired, especially when the cord 14 is elastic, the restraining means 11 may be omitted.

Additional means for restraining cord 14 is shown in FIG. 4. In this embodiment cover 10*b* has extension 40 extending inwardly from cover 10*b*, extension 40 being of tubular configuration with the tubular opening thereof extending through cover 10*b* to form an opening generally designated 31 (FIG. 3). Coil spring 22, shown in dotted lins in FIG. 4 under spring cover 42, and contained thereby within spring cover 42, has one end attached to extension 40 and the other end attached to spring cover 42. Spring cover 42 has a center aperture, generally designated 43, for receiving extension 40 therethrough.

Cord 14 is attached at one end of spring cover 42 and wound thereabout before extending through opening 15 to attach to lighter 12. Extension of lighter 12 away from housing 10 unreels cord 14 to thereby rotate spring cover 42 to apply tension to spring 22.

Release button 41 (FIG. 3) extends through aperture 31 and has cross-piece 44 thereon which is positioned in slot 46 of extension 40 and thereby constrained from rotary movement. Spring cover 42 has protrusions or tabs 45 extending therefrom for engagement with cross-piece 44. Cross-piece 44 has a ramp shaped surface such that the unreeling of cord 14 and corresponding rotation of spring cover 42 allows tabs 45 to ride up and over the ramp of cross-piece 44 but locks spring cover 42 in rotary position after passing over the ramp. If desired, tabs 45 may have corresponding complimentary ramp configured surfaces to facilitate movement of the tabs over the ramps of cross-piece 44.

Pressure on release button 31 raises cross-piece 44 over tabs 45 to allow the spring tension to rotate the spring cover 42 to retract cord 14.

Cross-piece 44 is shown with protrusions 47 for contacting the inside of cover 10*a* when button 31 is pushed to thereby selectively limit the extension of cross-piece 44 away from spring cover 42.

While there has been shown and described a preferred and one other embodiment, it is to be understood that various other adaptations and modifications may be made within the spirit and scope of the invention.

What is claimed is:

1. A cigarette lighter holder assembly comprising:

a housing formed of two cup shaped portions in facing relation to define a hollow interior;

compartment means formed in the periphery of said housing, said compartment means including a back and opposing first and second edges generally transverse thereto, the dimensions of said edges and said back generally corresponding to the length and width of a lighter to be retained therein;

means, including spring means, in proximate relation to said compartment means for enabling releasable retention of a cigarette lighter within said compartment means in proximate relation to said back and between said edges; a retractable spring loaded reel mechanism mounted within said housing;

cord means having a first end thereof within said housing attached to said reel mechanism and a second end extending externally to said housing;

said second end of said cord means being attached to said spring means; and said retractable reel mechanism includes cord retraining and release means for selectively retaining the amount of extension of said cord at selected points, the release of which allows said reel mechanism to retract the lighter.

2. A cigarette lighter and holder assembly comprising:

a cigarette lighter having a generally elongate body with a top and bottom, and said top and bottom of said body each have recess means formed therein;

a housing formed of two cup shaped portions in facing relation to define a hollow interior;

compartment means formed in the periphery of said housing, said compartment means including a back and opposing first and second edges generally transverse thereto, the dimensions of said edges and said back generally corresponding to the length and width of the body of said lighter;

a retractable spring loaded reel mechanism mounted within said housings;

cord means having a first end thereof within the housing attached to said reel mechanism and a second end extending externally to said housing adjacent said compartment;

means on said second end of said cord means configured and adapted for attachment to the body of said cigarette lighter; and means in proximate relation to said compartment means including means for engaging said recess means, for enabling releasable retention of the body of said cigarette lighter within said compartment means in proximate relation to said back and between said edges.

3. A cigarette lighter and holder assembly comprising:

a cigarette lighter having a generally elongate body with a top and bottom, said top and bottom each including recess means;

a housing formed of two cup shaped portions in facing relation to define a hollow interior;

compartment means formed in the periphery of said housing, said compartment means including a back and opposing first and second edges generally transverse thereto, the dimensions of said edges and said back generally corresponding to the length and width of the body of said lighter;

a retractable spring loaded reel mechanism mounted within said housing;

cord means having a first end thereof within the housing attached to said reel mechanism and a second end extending externally to said housing adjacent said compartment;

means on said second end of said cord means configured and adapted for attachment to the body of said cigarette lighter; and means in proximate relation to said compartment means for enabling releasable retention of the body of said cigarette lighter within said compartment means in proximate relation to said back and between said edges; and wherein said first and second edges include openings therein, and wherein said spring means include first and second spring members having portions thereof extending through said openings, said spring portions being dimensioned, positioned and configured for engagement with said recess means of the body of said cigarette lighter for retaining said lighter within said compartment means with a surface therof abutting said back.

4. The assembly according to claim 3 wherein said housing includes cord retraining and release means for selectively retaining the amount of extension of said cord at selected points, the release of whih allows said reel mechanism to retract the lighter.

5. The assembly according to claim 4 wherein saic cord is at least partially elastic.

6. A cigarette lighter and housing assembly comprising:

a cigarette lighter;

a housing formed of two cup shaped portions in facing relation to define a hollow interior;

compartment means formed in the periphery of said housing, said compartment means including a back and opposing first and second edges generally transverse thereto, the dimensions of said edges and said back generally corresponding to the length and width of the body of said lighter;

means at least partially within said housing means and extending into said compartment means for enabling releasable retention of said cigarette lighter within said compartment means is proximate relation to said back and between said edges;

a retractable spring loaded reel mechanism mounted within said housing;

cord means having a first end thereof within the housing attached to said reel mechanism and a second end extending externally to said housing;

means on said second end of said cord means configured and adapted for attachment to the body of said cigarette lighter.

7. The assembly according to claim 6 wherein said reel mechanism includes cord restraining means for selectively retaining the amount of extension of said cord to selected lengths, and release means for releasing said restraining means to thereby allow said reel mechanism to retract said lighter.

8. The assembly according to claim 7 wherein said cord restraining means includes a first surface and said release means includes a second surface, said first and second surfaces positioned in engaging coacting relationship and respectively configured to permit extension of said cord while locking retraction of said cord at selected lengths.

9. The assembly according to claim 8 wherein said release means includes means for disengaging said coacting surfaces to allow retraction of said cord by said reel mechanism.

10. The assembly according to claim 9 wherein said release means includes said second surface and said first surface is mounted in rotateable relationship to said second surface.

11. The assembly according to claim 10 wherein said cord is at least partially elastic.

12. A cigarette lighter holder assembly comprising:

a housing formed of two cup shaped portions in facing relation to define a hollow interior;

compartment means formed in the periphery of said housing, said compartment means including a back and opposing first and second edges generally transverse thereto, the dimensions of said edges and said back generally corresponding to the length and width of a lighter to be retained therein, and wherein said first and second edges include openings therein, means in proximate relation to said compartment means, including spring means, for enabling releasable retention of a cigarette lighter within said compartment means in proximate relation to said back and between said edges, said spring means including first and second spring members having portions thereof extending through said opening, said spring portions being dimensioned, positioned and configured for engagement with existing portions of a cigarette lighter for retaining the lighter within said compartment means with a surface thereof abutting said back;

a retractable spring loaded reel mechanism mounted within said housing;

cord means having a first end thereof within said housing attached to said reel mechanism and a second end extending externally to said housing;

means on said second end of said cord means configured and adapted for attachment to a cigarette lighter; and said retractable reel mechanism includes cord restraining and release means for selectively retaining the amount of extension of said cord at selected points, the release of which allows said reel mechanism to retract a lighter attached to said second end of said cord means.

13. The assembly according to claim 12 wherein said cord is at least partially elastic.

* * * * *